US012679605B2

(12) United States Patent
Drees et al.

(10) Patent No.: US 12,679,605 B2
(45) Date of Patent: Jul. 14, 2026

(54) CLOSURE SYSTEM AND KIT

(71) Applicant: HOFFMANN-LA ROCHE, Little Falls, NJ (US)

(72) Inventors: Guido Drees, Basel (CH); Neil Bentley Cammish, Manchester (GB)

(73) Assignee: HOFFMANN-LA ROCHE INC., Little Falls, NJ (US)

( * ) Notice: Subject to any disclaimer, the term of this patent is extended or adjusted under 35 U.S.C. 154(b) by 56 days.

(21) Appl. No.: 18/246,714

(22) PCT Filed: Sep. 28, 2021

(86) PCT No.: PCT/EP2021/076592

§ 371 (c)(1),
(2) Date: Mar. 27, 2023

(87) PCT Pub. No.: WO2022/064054

PCT Pub. Date: Mar. 31, 2022

(65) Prior Publication Data

US 2023/0382603 A1 Nov. 30, 2023

(30) Foreign Application Priority Data

Sep. 28, 2020 (EP) ..... 20198779

(51) Int. Cl.
*B65D 41/28* (2006.01)
*B65D 41/16* (2006.01)

(52) U.S. Cl.
CPC ..... *B65D 41/28* (2013.01); *B65D 41/16* (2013.01); *B65D 2251/0015* (2013.01); *B65D 2251/0075* (2013.01)

(58) Field of Classification Search
CPC ..... B65D 41/28; B65D 41/16; B65D 45/30; B65D 51/002; B65D 51/241; B65D 1/023;

(Continued)

(56) References Cited

U.S. PATENT DOCUMENTS 654,533 A * 7/1900 Garner ..... B65D 41/28 215/277
2,848,130 A * 8/1958 Jesnig ..... B65D 51/002 215/358

(Continued)

FOREIGN PATENT DOCUMENTS

DE 8613068 U1 6/1986
DE 4011878 A1 * 10/1991 ..... B65D 51/002
WO 2006059522 A1 6/2006

OTHER PUBLICATIONS

Written Opinion and International Search Report issued Jan. 18, 2022 in Intl Appl. No. PCT/EP2021/076592.

*Primary Examiner* — Orlando E Aviles
*Assistant Examiner* — Brijesh V. Patel
(74) *Attorney, Agent, or Firm* — MEDLER FERRO WOODHOUSE & MILLS PLLC

(57) ABSTRACT

A closure system is disclosed for closing an opening of a container. The system includes a stopper member made of an elastic material, a plug portion configured to tightly fit into the container opening and a cover portion configured to abut a boundary surface adjacent to the container opening. A cage member of the system is made of a shape-retentive material, and includes a stopper contacting section, a clipping structure and an intermediate section therebetween. The clipping structure is configured to clip in a corresponding structure of the container. The cage member is configured such that the stopper contacting section applies a pressure to the stopper member cover portion to push the stopper member cover portion onto the boundary surface of the container opening, when the stopper member plug portion is fitted into the container opening and the cage member clipping structure clips in the corresponding structure of the container.

19 Claims, 5 Drawing Sheets

(58) Field of Classification Search
CPC ..... B65D 39/0076; B65D 81/18; B65D 2251/0015; B65D 2251/0075; A61J 1/00; A61J 1/1412; A61J 1/1406
USPC ..... 215/40, 247, 249, 272–274, 277, 215/296–297, 364, 355; 220/315, 319, 220/800–802; 604/200–201, 256, 411, 604/415, 905
See application file for complete search history.

(56) References Cited

U.S. PATENT DOCUMENTS 3,088,615 A * 5/1963 Wheaton ..... B65D 51/005 215/249
3,193,128 A * 7/1965 Ravn ..... B65D 51/002 215/250
3,358,865 A * 12/1967 Andersen ..... B65D 51/002 215/249
3,547,297 A * 12/1970 Robert ..... B65D 51/002 215/249
3,578,200 A * 5/1971 Hetzer ..... B65D 39/0023 138/96 T
3,661,291 A * 5/1972 Hetzer ..... F16L 55/1108 411/908
3,682,349 A * 8/1972 Cospen ..... B65D 39/16 220/200
3,695,478 A * 10/1972 Sie ..... B65D 51/002 220/800
3,712,498 A * 1/1973 Lawrence ..... B65D 51/002 215/277
3,888,377 A * 6/1975 Stadler ..... A61J 1/18 215/249
3,900,122 A * 8/1975 Dichter ..... B65D 39/04 215/355
3,958,572 A * 5/1976 Lawhead ..... B01L 3/50825 215/320
D248,545 S * 7/1978 Summers ..... D9/439
4,098,422 A * 7/1978 Slomski ..... B65D 39/0017 215/320
4,205,754 A * 6/1980 Nielsen ..... B65D 51/002 215/249
4,211,333 A * 7/1980 Villarejos ..... B65D 51/241 215/277
4,230,231 A * 10/1980 Burnett ..... B65D 41/28 215/354
4,251,003 A * 2/1981 Bodenmann ..... B65D 55/02 215/254
4,293,078 A * 10/1981 Percarpio ..... B01L 3/50825 215/270
4,387,819 A * 6/1983 Corsette ..... B65D 47/10 222/569
4,441,621 A * 4/1984 Matukura ..... B65D 39/00 215/247
4,471,879 A * 9/1984 Connor ..... B65D 51/002 215/249
4,562,932 A * 1/1986 Finnern ..... B65D 51/002 215/249
4,741,446 A * 5/1988 Miller ..... B01L 3/50825 215/247
4,750,525 A * 6/1988 Vaughan ..... F16L 55/11 285/423
4,893,636 A * 1/1990 Cook ..... B65D 51/002 215/296
4,984,415 A * 1/1991 Kuroda ..... B65D 51/002 53/489
5,060,659 A * 10/1991 Cook ..... A61B 5/150351 215/296
5,069,369 A * 12/1991 McGarvey ..... B05B 11/1049 222/542
5,085,332 A 2/1992 Gettig et al.
5,088,612 A * 2/1992 Storar ..... B65D 51/002 215/237
5,125,921 A * 6/1992 Duschek ..... B65D 51/002 604/416
5,152,413 A * 10/1992 Conrad ..... B21D 51/38 215/249
5,171,304 A * 12/1992 Ris ..... B65D 51/002 215/358
5,232,109 A * 8/1993 Tirrell ..... B65D 51/002 215/355
5,299,703 A * 4/1994 Cater ..... B05B 11/1049 222/321.7
5,314,084 A * 5/1994 Folta ..... B65D 51/241 215/350
D349,648 S * 8/1994 Tirrell ..... D9/439
5,335,801 A * 8/1994 Lee ..... B65D 51/002 220/366.1
5,361,921 A * 11/1994 Burns ..... A61B 5/150351 215/320
5,405,031 A * 4/1995 Derksen ..... B65D 51/002 215/237
5,421,469 A * 6/1995 Lee ..... B65D 55/0872 215/280
5,555,988 A * 9/1996 Koch ..... B65D 51/002 215/249
5,656,112 A * 8/1997 Kuroda ..... B29C 65/18 53/488
5,718,348 A * 2/1998 Manera ..... B65D 41/28 215/249
5,817,082 A * 10/1998 Niedospial, Jr ..... A61J 1/2096 215/247
5,819,964 A 10/1998 Grimard
5,823,373 A * 10/1998 Sudo ..... B29C 45/33 215/249
5,853,094 A * 12/1998 Tanaka ..... B29C 45/14065 215/358
6,068,150 A * 5/2000 Mitchell ..... B65D 51/002 215/276
6,189,580 B1 * 2/2001 Thibault ..... A61J 1/2096 604/416
6,253,941 B1 * 7/2001 VanBrocklin ..... B65D 83/48 222/321.9
6,595,395 B2 * 7/2003 Jourdin ..... B65D 83/38 222/321.9
6,602,206 B1 * 8/2003 Niermann ..... A61B 5/150732 600/573
6,672,488 B2 * 1/2004 de Pous ..... B05B 11/1049 222/321.9
6,681,475 B2 * 1/2004 Thibault ..... B65B 7/285 53/410
6,772,913 B2 * 8/2004 Garcia ..... B65D 83/38 222/402.1
6,868,978 B2 * 3/2005 Amschlinger ..... A61J 1/18 215/253
7,207,452 B2 * 4/2007 Jourdin ..... G06Q 30/02 222/321.9
7,726,498 B2 * 6/2010 Anraku ..... A61B 5/150473 215/354
7,845,505 B2 * 12/2010 Hamamoto ..... B65D 41/28 215/280
7,850,028 B2 * 12/2010 Morini ..... B65D 41/3428 215/220
8,056,756 B2 * 11/2011 Okiyama ..... A61J 1/1475 604/167.03
8,303,914 B2 * 11/2012 Zurcher ..... B01L 3/50825 422/549
D681,230 S * 4/2013 Mosler ..... D24/129
8,430,277 B2 * 4/2013 Dumont ..... B65D 83/425 222/402.1
8,544,665 B2 * 10/2013 Bogle ..... B65D 51/241 215/294
8,544,691 B2 * 10/2013 Roosel ..... B05B 11/1049 222/153.04
8,627,970 B2 * 1/2014 Macy ..... A61B 5/150259 220/259.3
8,684,225 B2 * 4/2014 Gelibert ..... B65D 51/002 215/277

(56) References Cited

U.S. PATENT DOCUMENTS 8,777,031 B2 * 7/2014 Aneas ..... B65D 51/241 215/277
8,950,609 B2 * 2/2015 Aneas ..... A61J 1/1425 215/277
8,978,909 B2 * 3/2015 Kakutani ..... B65D 51/002 215/296
9,382,044 B2 * 7/2016 Chanas ..... B65D 41/48
9,555,941 B2 * 1/2017 Ogawa ..... A61J 1/1425
9,731,878 B2 * 8/2017 Suzuki ..... B29C 70/68
10,144,560 B2 * 12/2018 Mutterle ..... B65D 51/002
10,183,791 B2 * 1/2019 Friedrich ..... B65D 41/44
10,285,905 B2 * 5/2019 Masuyama ..... A61J 1/1406
10,843,913 B2 * 11/2020 Mutterle ..... B65D 45/322
2008/0000870 A1 * 1/2008 Lopez Alvarez ..... A61J 1/1443 215/249
2009/0001042 A1 * 1/2009 Sever ..... B65D 51/241 215/277
2009/0134114 A1 * 5/2009 Thilly ..... B65D 51/002 53/485
2009/0166311 A1 * 7/2009 Claessens ..... B65D 41/28 215/247
2010/0050575 A1 * 3/2010 Aneas ..... B65D 51/002 53/485
2010/0089862 A1 * 4/2010 Schmitt ..... B65D 51/241 215/249
2010/0224632 A1 * 9/2010 Aneas ..... B65D 51/002 220/315
2010/0243599 A1 * 9/2010 Chae ..... B65D 45/322 215/280
2012/0187072 A1 * 7/2012 Belle ..... B65D 45/32 215/274
2013/0213924 A1 8/2013 Vrijens et al.
2015/0360826 A1 * 12/2015 Fournier ..... B65D 51/002 215/277
2021/0009319 A1 * 1/2021 Clavel ..... B65D 45/30
2021/0009320 A1 * 1/2021 Clavel ..... A61J 1/14

* cited by examiner

CLOSURE SYSTEM AND KIT

TECHNICAL FIELD

The present invention relates to a closure system according to the preamble of independent claim 1 and more particularly to a kit having a container and such a closure system.

Such closure systems comprising an elastic stopper member having a plug portion configured to tightly fit into an opening of a container and a cover portion configured to abut a boundary surface adjacent to the opening of the container can be used for tightly and securely closing the opening of the container, in particular, with respect to liquids and gases.

BACKGROUND ART

In many chemical or pharmaceutical applications liquid substances such as drug substances, chemical substances, substances of clinical trials or others are provided in specific containers such as vials, cartridges or the like. These containers typically have a hollow interior and an opening through which the interior is accessible. The opening typically is surrounded by an edge. The substances are then filled into the interior of the containers and the openings are closed.

For closing the containers it is known to use elastic stoppers. Such stoppers may provide for tightly or even hermetically sealing the openings and additionally to allow retrieval of the substances out of the containers by piercing the stoppers with needles and introducing the needles into the substances. Typically, such stoppers have a plug portion and a cover portion, wherein the plug portion is dimensioned to tightly fit into the opening and the cover portion is shaped to abut the edge of the opening. More specifically, the stoppers are pressed into the opening such that the cover portions are compressed to a certain extent to generate sufficient tightness. As required in many applications, stoppers and containers of the kind allow for an efficient aseptic filling and closing of the container. Further, on an industrial scale, containers such as particularly vials, and stoppers are often dimensioned in predefined sizes and dimension. Like this, automated processing with standard equipment can be efficiently allowed.

As mentioned, to achieve a sufficient tightness of the container after filling and closing, the stoppers have to be pressed onto the edges of the containers. To hold the stoppers in such pressed state typically caps are used which are arranged on and around the stoppers and openings. For example it is known to arrange a rigid plastic cap onto a neck of a vial being closed with a stopper. Thereby, the neck typically is completely covered by the plastic cap which holds the stopper in the pressed state.

Even though such capping systems allow for providing a tight closing of vials or other containers they usually do hinder visibility of the portion of the container around the opening. However, for example when highly potent drug substances or lyophilisation are involved visibility of the complete container is important. Further, known capping systems are typically not suitable for a comparably long term tight closing. Taking into account the tolerances in manufacture of vials, stoppers and plastic caps often a precise pressure application to the stopper in the short and longer term cannot be assured.

Therefore, there is a need for a device or system preventing the above drawbacks and shortcomings.

DISCLOSURE OF THE INVENTION

According to the invention this need is settled by a closure system as it is defined by the features of independent claim 1, and by a kit as it is defined by the features of independent claim 15. Preferred embodiments are subject of the dependent claims.

In one aspect, the invention is a closure system for closing an opening of a container, comprising an elastic stopper member and a cage member. The stopper member has a plug portion configured to tightly fit into the opening of the container and a cover portion configured to abut a boundary surface adjacent to the opening of the container, typically while the plug portion is fitted into the opening. The boundary surface can be a portion of the container limiting the opening of the container. It can be part of an edge limiting the opening. Advantageously, the boundary surface is essentially planar.

The container can be a container used in pharmaceutical or chemical research, development or production such as a cartridge. It can particularly be a vial.

The term "vial" as used herein can relate to vials in the literal sense, i.e. a comparably small vessel or bottle, often used to store pharmaceutical products or pharmaceuticals or medications in liquid, powdered or capsuled form. The vial can be made of a sterilisable material such as glass or plastic such as, e.g., polypropylene, a cyclic olefin copolymer or a cyclic olefin polymer.

The stopper member is made of an elastic material such as an elastomeric material. The term "elastic" in connection with the stopper member can relate to properties of the material the stopper member is made of. More specifically, such material properties can be elasto-plastic and, in particular, compressible. Advantageously, the material of the stopper member allows to be sterilized and to maintain aseptic conditions. The stopper member can be embodied as one piece, i.e. as a monolithic element. The plug portion can be essentially cylindrical such that it matches the geometry of the opening. To allow the cover portion to abut the boundary surface, the cover portion typically laterally or radially projects over the port portion. It can be more or less disc shaped.

The cage member is made of a shape-retentive material, having a stopper contacting section, a clipping structure and in intermediate section between the stopper contacting section and the clipping structure. The term "shape retentive" as used herein relates to a material or structure being capable of maintaining its form when no force is applied. In particular, the shape retentive material can be dimensionally stable. Typically, shape-retentive materials are comparably rigid. Particularly, the material of the cage member can be more rigid than the material of the stopper member. Also, the shape-retentive material preferably is sufficiently elastic to allow clipping as described below. Preferably, the shape-retentive material is a metal such as a steel and particularly a stainless steel. The stopper contacting section, the clipping structure and the intermediate section of the cage member advantageously are embodied as one piece, i.e. a monolithic element.

The stopper contacting section can particularly be embodied to planarly or flatly abut at least a section of the cover portion of stopper member. For example, it can have a shape of a circular disk or a flat ring dimensioned to cover a section of the stopper member being positioned on the boundary surface of the container when the stopper member is fitted into its opening. In particular, when being mounted, the cover section of the stopper member can be positioned axially between the boundary surface and the cage member wherein the stopper contacting section advantageously is designed to abut the complete surface of the cover section of the stopper member being opposite to the surface contacting the boundary surface of the container. Like this, it can be achieved that the stopper member is equally compressed at a comparably large portion when the stopper contacting section is pushed onto the cover portion as described below.

The clipping structure of the cage member is configured to clip in a corresponding structure of the container. The term "clip" as used in this connection relates to snapping into or behind the corresponding structure, or a similar mechanism. Generally, such clipping typically involves an elastic deformation or dislocation of one element, such as the cage member, when moving two elements, such as the cage member and the container, together and then elastically deforming the one element back behind a structure of the second element once the two elements are properly positioned. More specifically, for allowing such clipping the clipping structure of the cage member can be elastically deformed or bent relative to the other portions of the cage member. The clipping structure allows for providing a snap-fit connection between the cage member and the container. Once clipped or snap-fitted to the container, the cage element is in a form fit connection with the container. Advantageously, when being clipped to the container, the cage element cannot be removed from the container without being destroyed or broken.

The cage member is configured such that the stopper contacting section of the cage member applies a pressure to the cover portion of the stopper member to push the cover portion of the stopper member onto the boundary surface adjacent to the opening of the container, when the plug portion of the stopper member is fitted into the opening of the container and the clipping structure of the cage member clips in the corresponding structure of the container.

The force applied by the stopper contacting section of the cage member to the cover portion of the stopper member can be in a range from about 10 Newton (N) to about to about 100 N depending on the material characteristics and geometry of the stopper member. For example, it can be about 15 N. Like this, the stopper member can be compressed between the stopper contacting section of the cage member and the boundary surface of the container such that an appropriate tightness between stopper member and container can be achieved and maintained.

The closure system according to the invention allows for securely closing the container in a tight manner and under sterile conditions. It further allows efficient processing and handling using legacy accessories such as vial transfer devices or the like. Also, the closing may efficiently be implemented in one step by mounting the stopper member pre-assembled in the cage member.

The intermediate section of the cage member can be designed surround a portion of the container adjacent to the boundary surface adjacent to the opening. In case the container is a vial or a similar container, the intermediate section can be configured to surround a head of the vial which comprises the opening and the boundary surface. Thus, the intermediate section of the cage member preferably is configured to surround a head portion of the container.

Preferably, the intermediate section of the cage member is cylindrical. Like this, the intermediate section can efficiently be designed to surround the head portion of the container or for other reasons. In particular, the intermediate section can have the shape of a small cylinder or ring. The term "small" in connection with the cylinder may relate to a cylinder having a height or axial length which is smaller than a diameter. The cylinder can particularly have a circular cross section.

Preferably, the clipping structure of the cage member comprises a plurality of tongues. For example, a number of the plurality of tongues can be in a range of about four to twelve, of about four to eight or of about six. Such tongues allow for providing an efficient and safe clipping of the cage member to the container. In particular, a rigidity and elasticity of the clipping structure can be suitably configured by means of such tongues. Also, the tongues may be configured to prevent the cage member from being detached from the container if it is clipped to the container.

Thereby, each of the tongues of the clipping structure of the cage member preferably is elastically movable relative to the intermediate section of the cage member. Particularly in connection with the tongues of the clipping structure, the term "elastic" or "elasticity" as used herein relates to the ability of a body, element or portion to be deformed by an influence or force and to return to its original shape when that influence or force is removed. More specifically, the tongues of the clipping structure are movable relative to the intermediate section by means of an influence or force and move back essentially to their original shape and/or position once the influence or force is removed, i.e. the tongues are elastically movable. Elasticity in this sense is opposite to plasticity in which the body, element or portion remains in its deformed state after removal of the force or influence. The elastically movable tongues allow the cage member to efficiently clip to the container. Thereby, after being clipped to the container, the cage member may be form fitted to the container and, thus, being non-removable therefrom.

In particular, the cage member can be configured such that, when being clipped to the container, the intermediate section is essentially not deformed but the tongues are elastically moved. The elastic movability of the tongues, e.g., can be provided by tongues outwardly bending and/or by the tongues being tilted about a joint portion. In particular, the tongues can be elastically movable by being at least partially deformed in an elastic manner, i.e. tending to move back to the original shape and/or position. The tongues may allow for some normal relaxation due to material properties.

Further, each of the tongues of the clipping structure of the cage member preferably is elastically movable relative to the intermediate section of the cage member. In particular, the tongues may be elastically movable in a radial or outward direction.

Preferably, the stopper contacting section of the cage member comprises an aperture such that the cover portion of the stopper member is accessible through the aperture of the stopper contacting section when the plug portion of the stopper member is fitted into the opening of the container and the clipping structure of the cage member clips in the corresponding structure of the container. The opening can particularly be located adjacent to a surface of the cover portion of the stopper member being in correspondence with the opening of the container when the stopper member is fitted into the opening and the cage member is clipped on the container. Thereby, the opening can be aside the section of stopper contacting section abutting the surface of the cover section of the stopper member being opposite to the surface contacting the boundary surface of the container. Like this, the accessible portion of the stopper member can be easily accessed and cleaned, e.g., by alcohol swabbing. For example, the aperture of the stopper contacting section can be a circular central aperture of the stopper contacting section being a flat ring.

Thereby, the closure system preferably comprises a cover reversibly mountable to the stopper contacting section of the cage member to close the aperture of the stopper contacting section of the cage member. The term "reversibly mountable" as used in this context relates to a configuration of the cover and cage member allowing the cover to be de-mounter and re-mounted plural times. Like this, the aperture of the cape member can repeatedly be accessed which allows for an efficient operation. Such cover may be embodied as a rigid and essentially disk shaped element. It can be provided with a connection structure to engage a corresponding connection structure of the stopper contacting section. For example, such connection structures may be a thread connection, a bayonet closure, or the like.

Even though being particularly beneficial in the closure system according to the invention, the specific stopper member described herein and particularly in the following can also be used in other closure systems. Therefore, the following stopper member alone is another aspect of the invention.

Preferably, the cover portion of the stopper member preferably has a circumferential cage notch directed away from the boundary surface adjacent to the opening when the plug portion of the stopper member is fitted into the opening of the container. The term "directed away" in connection with the cage notch may particularly relate to a direction opposition to a direction towards the boundary surface adjacent to the opening of the container. For example, the cover portion can be more or less disk shaped having a top side and a bottom side opposite to the top side. Thereby, the cage notch may be positioned at the top side of the cover portion. The cage notch allows the stopper member to collapse when being pushed by the cage member. In particular, at a portion where the stopper contacting section of the cage member applies a pressure on the stopper member the cage notch may collapse in dependence of the force applied. Like this, a well-defined compression of the stopper member can be achieved and the risk of damaging the stopper member while being compressed can be reduced.

Preferably, the cover portion of the stopper member has a circumferential container notch directed towards the boundary surface adjacent to the opening when the plug portion of the stopper member is fitted into the opening of the container. The container notch allows the stopper member to collapse when being pushed onto the boundary surface of the container. In particular, at or adjacent to the boundary surface of the container notch may collapse in dependence of a force applied to the stopper member. Like this, a well-defined compression of the stopper member can be achieved and the risk of damaging the stopper member while being compressed can be reduced.

In a particularly preferred embodiment, the stopper member is equipped with the cage notch and the container notch. Thereby, the cage notch of the cover portion of the stopper member preferably is radially offset relative to the container notch of the cover portion of the stopper member. Like this, it can be prevented that stability of the stopper member is essentially decreased. Also, such offset positioning allows for providing a sophisticated collapsing at both sides of the cover portion, reducing the overall compression rate of the stopper. Like this, the stopper can be compressed more than a solid stopper for the same applied force. This is beneficial as it allows for a thicker stopper to compensate for rigid component tolerances.

Preferably, the cover portion of the stopper member has an edge section with a front face configured to abut the boundary surface adjacent to the opening of the container, and with a back face opposite to and corresponding to the front face of the edge section, wherein the stopper contacting section of the cage member is configured to abut the complete back face of the edge section of the stopper member when the plug portion of the stopper member is fitted into the opening of the container and the clipping structure of the cage member clips in the corresponding structure of the container. Such complete abutting allows for an efficient and homogenous compression of the stopper member.

Preferably, the cage member is configured to end essentially adjacent to the clipping structure when the plug portion of the stopper member is fitted into the opening of the container and the clipping structure of the cage member clips in the corresponding structure of the container. When the container is equipped with a head portion having the boundary surface adjacent to the opening passing over into a neck portion, the cage member can be configured essentially not to extend over the neck portion of the container or to end at the neck portion of the container. Like this, it can be achieved that the neck is kept free which allows an efficient handling of the closed container and attachment to standard or legacy accessories such as transfer kits, and an appropriate optical inspection of the complete interior of the container including the neck.

In a further aspect, the invention is a kit comprising a container and a closure system as described above, wherein the container comprises an opening for accessing an interior of the container and a boundary surface adjacent to the opening.

By means of the kit according to the invention the effects and benefits in connection with the closure system according to the invention and its preferred embodiments can efficiently be achieved as described above.

BRIEF DESCRIPTION OF THE DRAWINGS

The closure system and kit according to the invention are described in more detail hereinbelow by way of exemplary embodiments and with reference to the attached drawings, in which.

DESCRIPTION OF EMBODIMENTS

In the following description certain terms are used for reasons of convenience and are not intended to limit the invention. The terms "right", "left", "up", "down", "under" and "above" refer to directions in the figures. The terminology comprises the explicitly mentioned terms as well as their derivations and terms with a similar meaning. Also, spatially relative terms, such as "beneath", "below", "lower", "above", "upper", "proximal", "distal", and the like, may be used to describe one element's or feature's relationship to another element or feature as illustrated in the figures. These spatially relative terms are intended to encompass different positions and orientations of the devices in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. The devices may be otherwise oriented (rotated 90 degrees or at other orientations), and the spatially relative descriptors used herein interpreted accordingly. Likewise, descriptions of movement along and around various axes include various special device positions and orientations.

To avoid repetition in the figures and the descriptions of the various aspects and illustrative embodiments, it should be understood that many features are common to many aspects and embodiments. Omission of an aspect from a description or figure does not imply that the aspect is missing from embodiments that incorporate that aspect. Instead, the aspect may have been omitted for clarity and to avoid prolix description. In this context, the following applies to the rest of this description: If, in order to clarify the drawings, a figure contains reference signs which are not explained in the directly associated part of the description, then it is referred to previous or following description sections. Further, for reason of lucidity, if in a drawing not all features of a part are provided with reference signs it is referred to other drawings showing the same part. Like numbers in two or more figures represent the same or similar elements.

Figure 1:
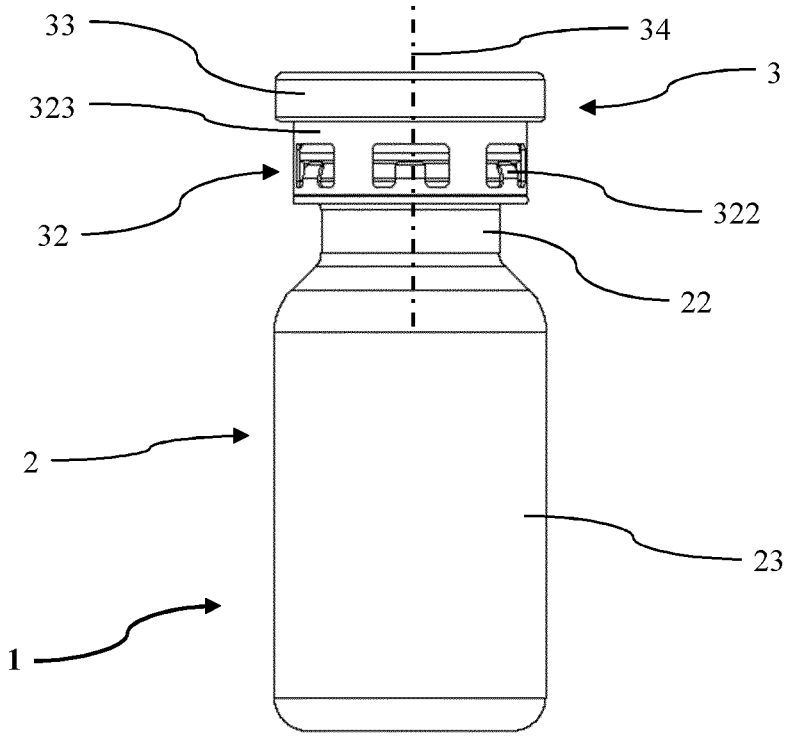
FIG. 1 shows side view of a first embodiment of a kit according to the invention comprising a first embodiment of a closure system according to the invention.

FIG. 1 shows a first embodiment of a kit 1 according to the invention comprising a vial 2 as container and a first embodiment of a closure system 3 according to the invention. In FIG. 1 the kit 1 is depicted in an assembled state where the closure system 3 is mounted to the vial 2.

The vial 2 is a 13 mm vial made of a plastic material. It has a body 23 with a hollow interior and a neck 22 passing over into a head 21 as head portion (not visible in FIG. 1). The closure system 3 is mounted to the head 21 of the vial such that the head 21 is covered. The closure system 3 comprises a metal cage 32 as cage member and a plastic cover 33. The cage 32 has an essentially cylindrical intermediate section 323 and a clipping structure with tongues 322 regularly distributed about the intermediate section 323. Furthermore, the closure system defines a central axis 34 which is in one line with the central axis of rotation of the vial 2 when the closure system 3 is mounted to the vial 2.

Figure 2:
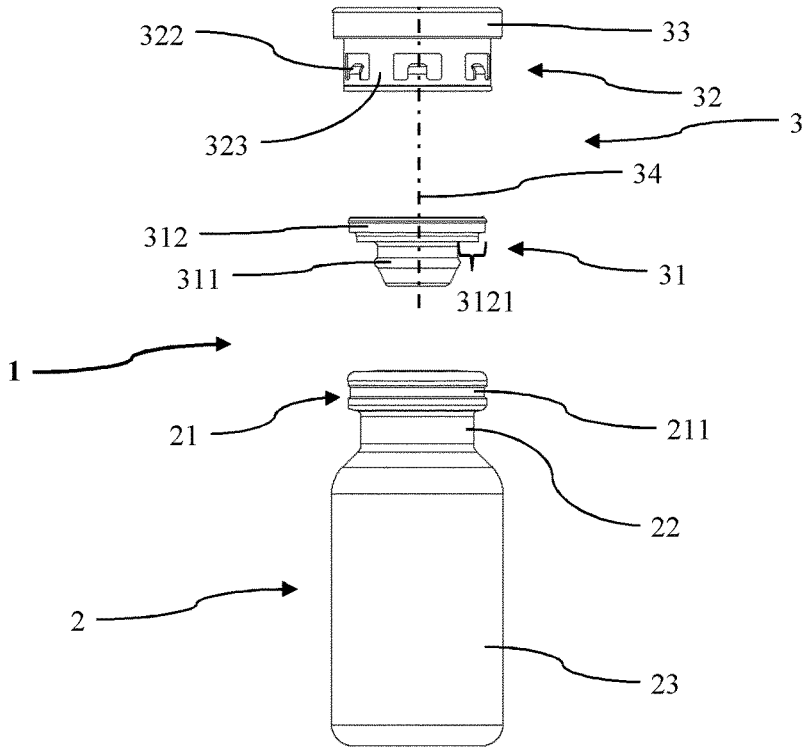
FIG. 2 shows an exploded side view of the kit and closure system according to the invention wherein an embodiment of a stopper member according to the invention comprised by the closure system is visible.

As can be seen in FIG. 2, the closure system 3 further comprises an embodiment of an elastic stopper 31 as stopper member according to the invention. The stopper 31 has a plug portion 311 and a more or less disk-shaped cover portion 312. The cover portion 312 radially extends over the plug portion 311 thereby forming an essentially ring-shaped edge section 3121 having a downwardly oriented front face and an opposite upwardly oriented back face corresponding to the front face.

The head 21 of the vial 2 radially extends over the neck 22 of the vial. The head 21 is equipped with a radial indentation 211 at its outer circumference. Furthermore, as best visible in FIG. 3, the vial 2 has a circular or cylindrical opening 25 at its head 21 which allows to access the interior of the body 23. A boundary surface 24 adjacent to the opening 25 is designed as a flat upwardly oriented surface.

Figure 3:
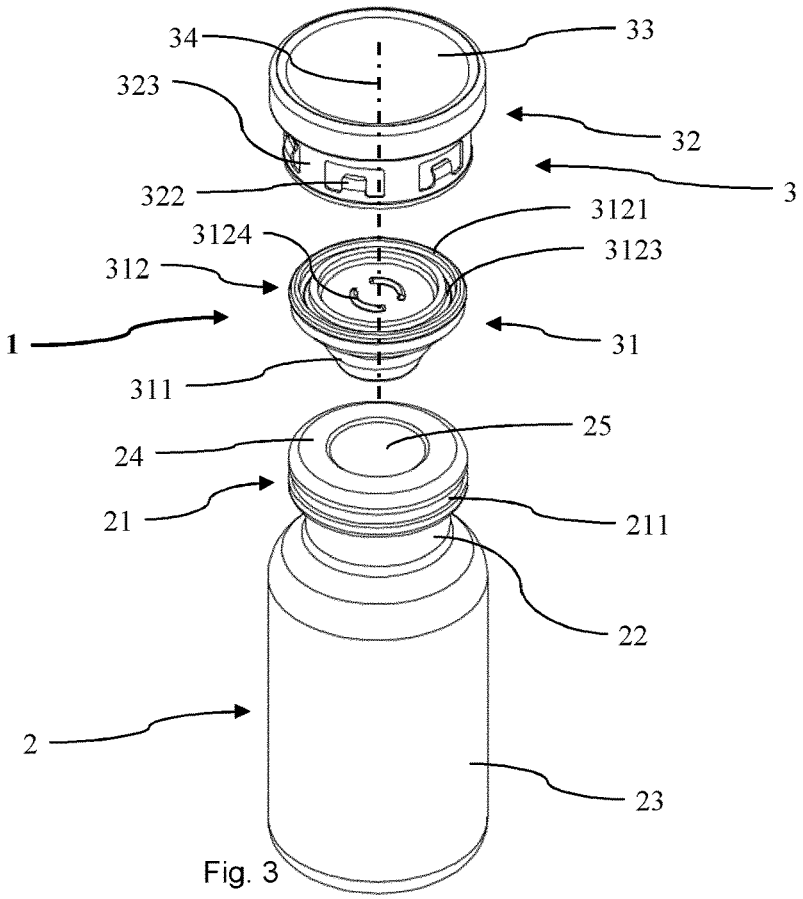
FIG. 3 shows an exploded perspective view of the kit, closure system and stopper member of FIG. 2.
Figure 4:
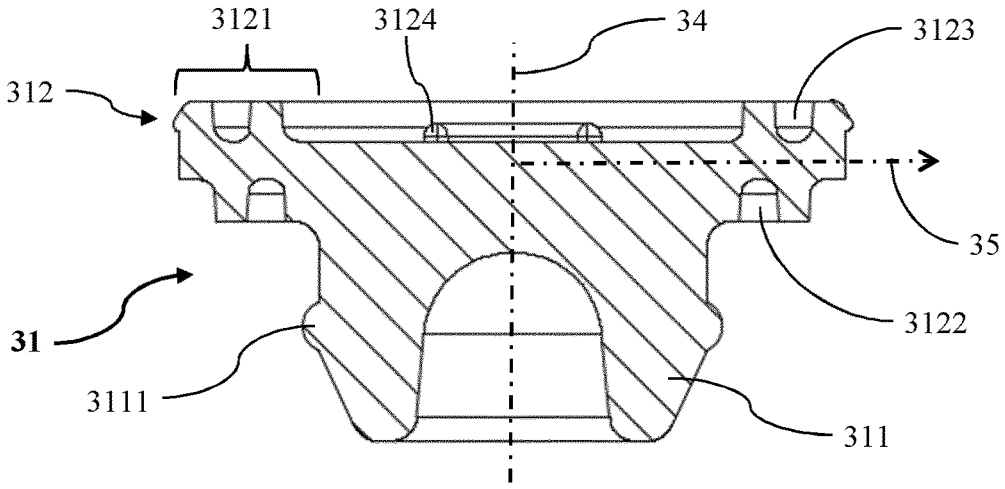
FIG. 4 shows a cross sectional view of the stopper member of FIG. 2.

FIG. 3 and particularly FIG. 4 show further details of the stopper 31. The edge section 3121 of the cover portion 312 is equipped at its back face with a circumferential cage notch 3123 and at its front face with a circumferential container notch 3122. In a radial direction 35, the circumferential cage notch 3123 and the circumferential container notch 3122 are offset to each other, i.e. the circumferential container notch 3122 is closer to the axis 34 than the circumferential cage notch 3123. Centrally, the cover portion 312 is equipped with a cage centering structure 3124.

The plug portion 311 has a dome shaped cavity downwardly opening. At its radial outer surface, the plug portion 311 is equipped with a circumferential bulge 3111. The bulge 3111 radially extends from the outer surface towards the axis 34.

Figure 5:
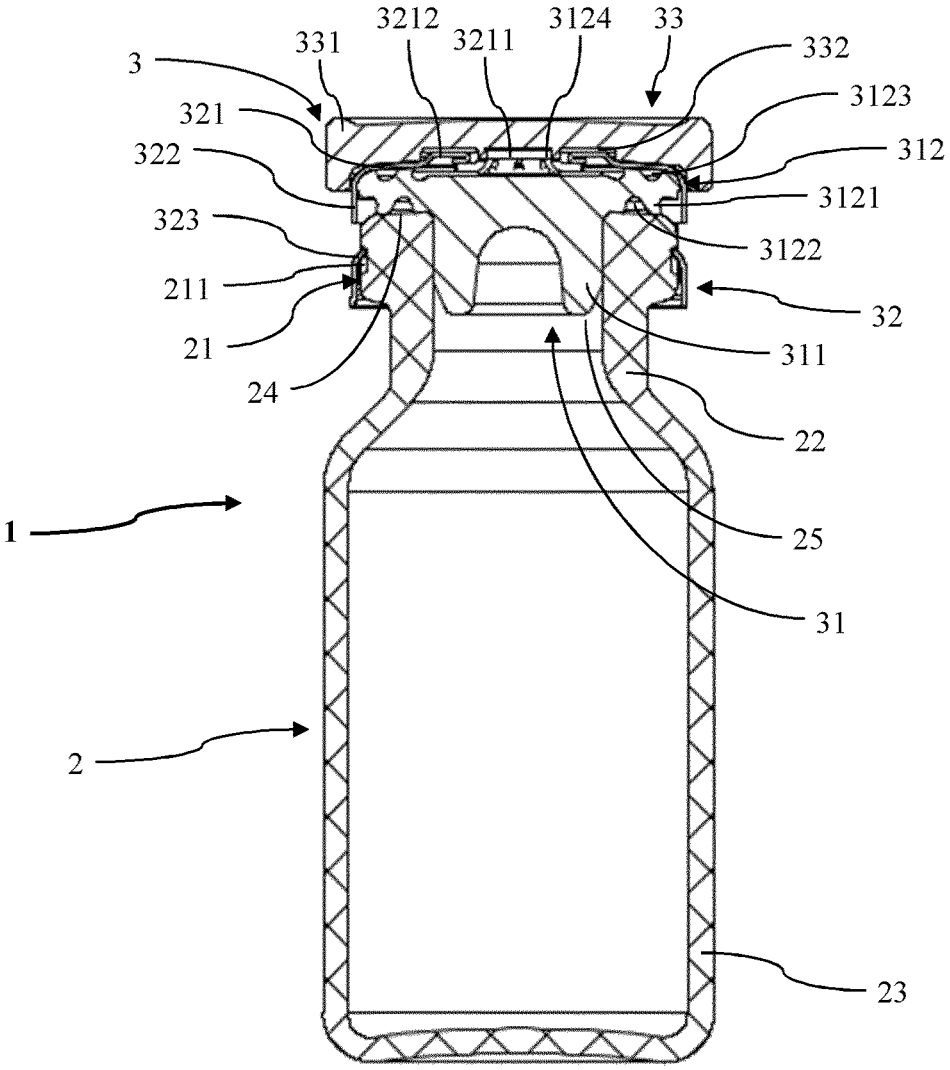
FIG. 5 shows a cross sectional view of the kit of FIG. 1.

In FIG. 5, the kit 1 is shown in an assembled state. Thereby, it can be seen that the plug portion 311 of the stopper 31 is configured to tightly fit into the opening 25 of the vial 2. In particular, the plug portion 311 is dimensioned such that the bulge 3111 is completely compressed when the plug portion 311 is pushed into the opening 25. The cover portion 312 abuts the boundary surface 24 adjacent to the opening 25 of the vial 2. More specifically, the front face of the edge section 3121 abuts the boundary surface 24 adjacent to the opening 25.

The cage 32 is made of stainless steel. It has a more or less disk-shaped stopper contacting section 321 with a central aperture 3211. The intermediate section 322 extends between the stopper contacting section 321 and the clipping structure with the tongues 323 and surround the head 21. The tongues 323 are clipped into the indentation 211 of the head 21 of the vial 2. More specifically, the tongues 323 upwardly extend and are curved inwardly towards the axis 34. When being mounted, the tongues 323 are temporarily outwardly bent or dislocated into the radial direction 35 relative to the intermediate section 322, wherein—due to the elasticity of the stainless steel—they snap in the indentation 211 as soon as the cage 32 is sufficiently moved onto the head 21 of the vial 2. Thereby, a form-fit connection between the cage 32 and the vial 2 is established which prevents removal of the cage 32.

The intermediate section 322 of the cage member 32 is dimensioned such that the stopper contacting section 321 applies a pressure to the cover portion 312 of the stopper 31. More specifically, the stopper contacting section 321 pushes the edge section 3121 of the cover portion 312 of the stopper 31 onto the boundary surface 24 adjacent to the opening 25 of the vial 2. Thereby, the back face of the edge section 3121 abuts the stopper contacting section 321 and the front face of the edge section 3121 abuts the boundary surface 24.

The pressure applied to the stopper 31 by the cage 32 deforms the edge section 3121 of the cover portion 321 of the stopper 32. Thereby, the cage notch 3123 and the edge notch 3122 are collapsed to a certain extent, which allows to generate a well-defined deformation of the cover portion 321. Like this, a secure tight connection between cover portion 321 and the boundary surface 24 is achieved.

The cage centering structure 3124 of the cover portion 312 of the stopper 31 extends into the aperture 3211 of the stopper contacting section 321 of the cage 32. The plastic cover 33 has an essentially disk-shaped body 331 which is equipped with downwardly oriented first bayonet members 332 at its bottom surface. An edge of the aperture 3211 of the stopper contacting section 321 of the cage 32 is equipped with corresponding upwardly oriented second bayonet members 3212. The first and second bayonet member 332, 3212 engage such that the cover is securely and reversibly mounted to the cage 32 and the aperture 3211 of the cage 32 is closed.

For accessing the interior of the vial 2, the plastic cover 33 is demounted from the cage 32 such that the stopper 31 is accessible through the aperture 3211. A needle of a syringe can now be pierced through the stopper 31 into the vial 2 and a substance arranged in the vial 2 can be withdrawn.

Figure 6:
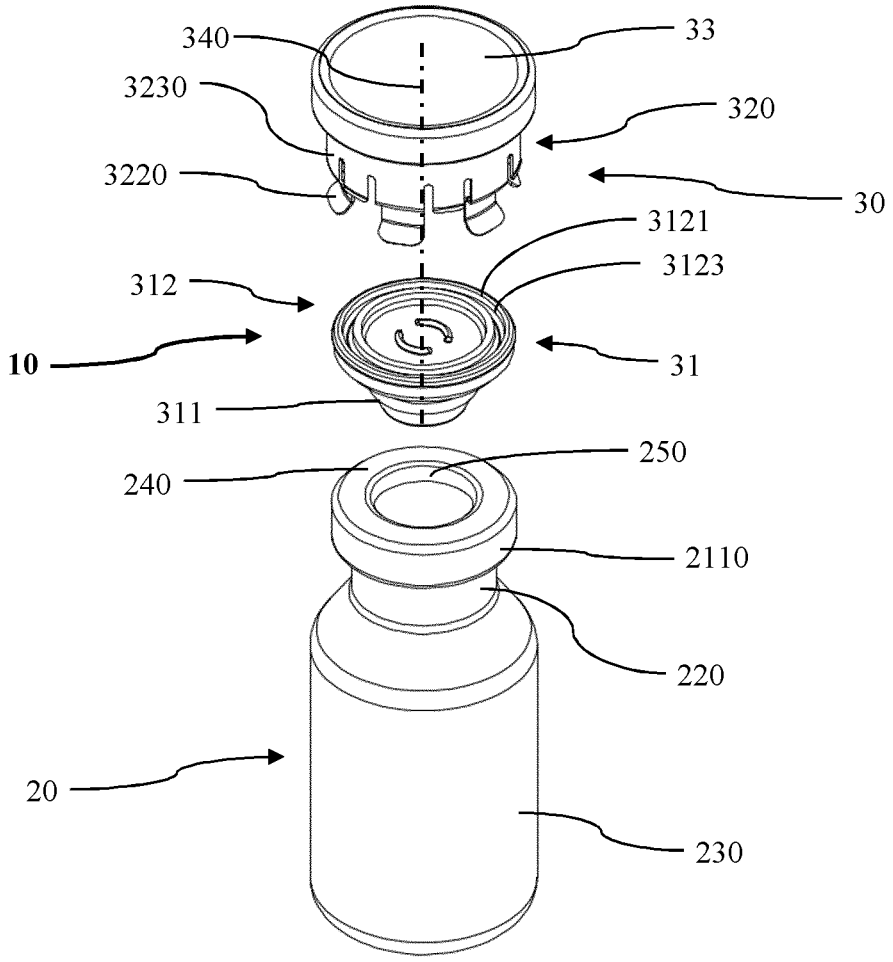
FIG. 6 shows an exploded perspective view of a second embodiment of a kit according to the invention comprising a second embodiment of a closure system according to the invention with the stopper member of FIG. 2.

FIG. 6 shows a second embodiment of a kit 10 according to the invention. The kit 10 comprises a glass vial 20 and a second embodiment of a closure system 30 according to the invention. The closure system 30 has the same plastic cover 33 and the same stopper 31 as described above in connection with the first closure system 3. With regard to these identical plastic cover 33 and stopper 31 it is particularly referred to FIGS. 4 and 5 as well as the description above.

The closures system 30 further comprises a cage 320 made of stainless steel as cage member. The cage 320 has an essentially cylindrical intermediate section 3230 and a clipping structure with tongues 3220 regularly distributed about the intermediate section 3230. Furthermore, the closure system 30 defines a central axis 340 which is one line with the central axis of rotation of the vial 20 when the closure system 30 is mounted to the vial 20. The tongues 3220 of the cage 320 downwardly extend from the intermediate section 3230.

The vial 20 can be a 13 mm or 20 mm glass vial, or a custom vial such as a vial with 15 mm diameter head. It has a body 230, a neck 220 and a head 210. The head 210 radially extends over the neck 220. The vial 20 has an opening 250 at its head 210 which allows to access the interior of the body 230. A boundary surface 240 adjacent to the opening 250 has a flat upwardly oriented surface.

Figure 7:
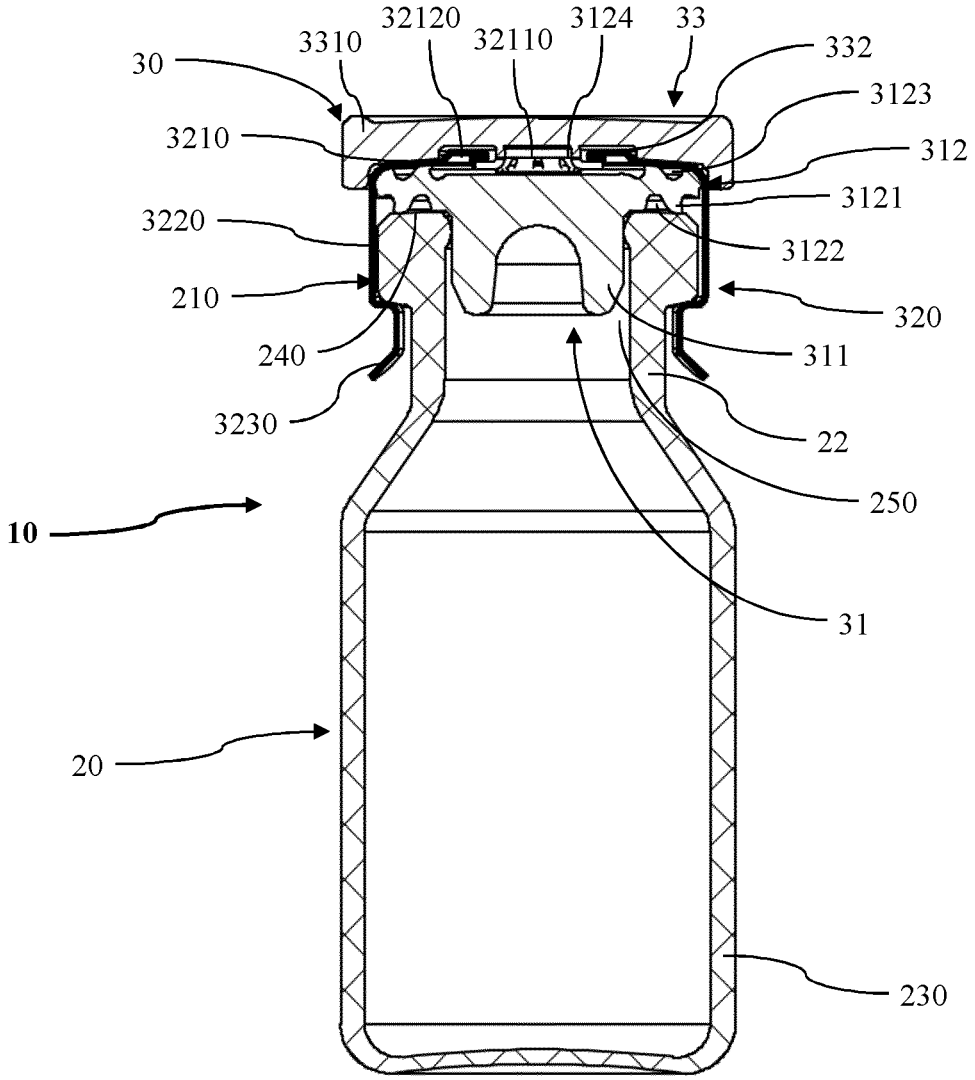
FIG. 7 shows a cross sectional view of the kit of FIG. 6.

In FIG. 7, the kit 10 is shown in an assembled state in which the closure system 30 is mounted to the vial 20. Thereby, the components of the kit 10 similarly interact as described above in connection with the first kit 1 shown in FIGS. 1 to 5. In the following it is focused on aspects of the second kit 10 being different from the first kit 1. In particular, aspects of the second kit 10 which are not described in the following are identical or similar to the first kit 1. In this connection it is referred to the description above.

The tongues 3230 of the cage 320 downwardly extending from the intermediate section 3220 clip the head 210 of the vial 20. In particular, the tongues 3230 inwardly extend from the intermediate section 3220 along a bottom end of the head 210, then downwardly extend along and abut the neck 220 and then diagonally extend in a down and outward direction. Specifically, the shape of the tongues 3230 allows for snap-fitting the cage 320 onto the head 210 of the vial 20 which does not have an indentation or the like. When being mounted to the vial 20, the cage 320 is axially moved onto the head 210. The diagonal portions of the tongues 3230 result in the tongues 3230 being outwardly bent or dislocated relative to the intermediate section 3220 until the cage 320 is sufficiently moved down such that—due to the elasticity of the stainless steel—the tongues 3230 are moved back into direction of the axis 340 thereby snapping behind the head 210 of the vial 20. Like this, the tongues 3220 are safely form-fitted to the head 210 and the cage 320 is locked on the vial 20 thereby pressing the stopper 310 onto the vial 20 as described above.

This description and the accompanying drawings that illustrate aspects and embodiments of the present invention should not be taken as limiting—the claims defining the protected invention. In other words, while the invention has been illustrated and described in detail in the drawings and foregoing description, such illustration and description are to be considered illustrative or exemplary and not restrictive. Various mechanical, compositional, structural, electrical, and operational changes may be made without departing from the spirit and scope of this description and the claims. In some instances, well-known circuits, structures and techniques have not been shown in detail in order not to obscure the invention. Thus, it will be understood that changes and modifications may be made by those of ordinary skill within the scope and spirit of the following claims. In particular, the present invention covers further embodiments with any combination of features from different embodiments described above and below.

The disclosure also covers all further features shown in the Figs. individually although they may not have been described in the afore or following description. Also, single alternatives of the embodiments described in the figures and the description and single alternatives of features thereof can be disclaimed from the subject matter of the invention or from disclosed subject matter. The disclosure comprises subject matter consisting of the features defined in the claims or the exemplary embodiments as well as subject matter comprising said features.

Furthermore, in the claims the word "comprising" does not exclude other elements or steps, and the indefinite article "a" or "an" does not exclude a plurality. A single unit or step may fulfil the functions of several features recited in the claims. The mere fact that certain measures are recited in mutually different dependent claims does not indicate that a combination of these measures cannot be used to advantage. The terms "essentially", "about", "approximately" and the like in connection with an attribute or a value particularly also define exactly the attribute or exactly the value, respectively. The term "about" in the context of a given numerate value or range refers to a value or range that is, e.g., within 20%, within 10%, within 5%, or within 2% of the given value or range. Components described as coupled or connected may be electrically or mechanically directly coupled, or they may be indirectly coupled via one or more intermediate components. Any reference signs in the claims should not be construed as limiting the scope.

The invention claimed is:

1. A closure system for closing an opening of a container, comprising:

a stopper member made of an elastic material and having a plug portion configured to tightly fit into the opening of the container and a cover portion configured to abut a boundary surface adjacent to the opening of the container; and a cage member made of a shape-retentive material, wherein the cage member has a stopper contacting section, a clipping structure and an intermediate section between the stopper contacting section and the clipping structure, wherein the clipping structure of the cage member is configured to clip in a corresponding structure of the container, wherein the cage member is configured such that the stopper contacting section of the cage member applies a pressure to the cover portion of the stopper member to push the cover portion of the stopper member onto the boundary surface of the opening of the container, when the plug portion of the stopper member is fitted into the opening of the container and the clipping structure of the cage member clips in the corresponding structure of the container, wherein the cover portion of the stopper member has a circumferential cage notch directed away from the boundary surface of the opening when the plug portion of the stopper member is fitted into the opening of the container, wherein the cover portion of the stopper member has a circumferential container notch directed towards the boundary surface of the opening when the plug portion of the stopper member is fitted into the opening of the container, wherein the circumferential cage notch of the cover portion of the stopper member is radially offset relative to the circumferential container notch of the cover portion of the stopper member, and wherein the circumferential cage notch is disposed at a first radial position on the cover portion of the stopper member and the circumferential container notch is disposed at a second radial position on the cover portion at the stopper member, and wherein the circumferential cage notch is the only notch of the cover portion at the first radial position and the circumferential container notch is the only notch of the cover portion at the second radial position.

2. The closure system of claim 1, wherein the shape retentive material of the cage member is a metal.

3. The closure system of claim 2, wherein the intermediate section of the cage member is configured to surround a head portion of the container.

4. The closure system of claim 1, wherein the intermediate section of the cage member is cylindrical.

5. The closure system of claim 4, wherein the clipping structure of the cage member comprises a plurality of tongues.

6. The closure system of claim 5, wherein each of the plurality of tongues inwardly extends from the cylindrical intermediate section and the plurality of tongues is regularly distributed about the cylindrical intermediate section.

7. The closure system of claim 5, wherein each of the plurality of tongues of the clipping structure of the cage member is elastically movable relative to the intermediate section of the cage member.

8. The closure system of claim 1, wherein the stopper contacting section of the cage member comprises an aperture such that the cover portion of the stopper member is accessible through the aperture of the stopper contacting section when the plug portion of the stopper member is fitted into the opening of the container and the clipping structure of the cage member clips in the corresponding structure of the container.

9. The closure system of claim 8, comprising a cover reversibly mountable to the stopper contacting section of the cage member to close the aperture of the stopper contacting section of the cage member.

10. The closure system of claim 1, wherein the cover portion of the stopper member has an edge section with a front face configured to abut the boundary surface of the opening of the container and a back face opposite to and corresponding to the front face of the edge section, wherein the stopper contacting section of the cage member is configured to abut the complete back face of the edge section of the stopper member when the plug portion of the stopper member is fitted into the opening of the container and the clipping structure of the cage member clips in the corresponding structure of the container.

11. The closure system of claim 1, wherein the cage member is configured to end essentially adjacent to the clipping structure when the plug portion of the stopper member is fitted into the opening of the container and the clipping structure of the cage member clips in the corresponding structure of the container.

12. The closure system of claim 1, wherein the force applied by the stopper contacting section of the cage member to the cover portion of the stopper member can be in a range from about 10 Newton to about to about 100 Newton.

13. The closure system of claim 1, wherein the cage member is configured such that the stopper contacting section of the cage member applies the pressure to the cover portion of the stopper member to compress the stopper member between the stopper contacting section of the cage member and the boundary surface of the container, when the plug portion of the stopper member is fitted into the opening of the container and the clipping structure of the cage member clips in the corresponding structure of the container.

14. The closure system of claim 1, wherein the circumferential cage notch is disposed at a first radial position on the cover portion of the stopper member and the circumferential container notch is disposed at a second radial position on the cover portion at the stopper member, the second radial position being closer to a central axis of the closure system than the first radial position.

15. The closure system of claim 1, wherein the cover portion of the stopper member has exactly one circumferential cage notch and exactly one circumferential container notch.

16. The closure system of claim 1, wherein the intermediate section of the cage member is cylindrical, wherein the clipping structure of the cage member comprises a plurality of tongues.

17. The closure system of claim 1, wherein the stopper contacting section of the cage member comprises an aperture such that the cover portion of the stopper member is accessible through the aperture of the stopper contacting section when the plug portion of the stopper member is fitted into the opening of the container and the clipping structure of the cage member clips in the corresponding structure of the container.

18. The closure system of claim 1, wherein the cage member is configured such that the stopper contacting section of the cage member applies the pressure to the cover portion of the stopper member to compress the stopper member between the stopper contacting section of the cage member and the boundary surface of the container, when the plug portion of the stopper member is fitted into the opening of the container and the clipping structure of the cage member clips in the corresponding structure of the container.

19. A closure system for closing an opening of a container, comprising:

a stopper member made of an elastic material and having a plug portion configured to tightly fit into the opening of the container and a cover portion configured to abut a boundary surface adjacent to the opening of the container; and a cage member made of a shape-retentive material, wherein the cage member has a stopper contacting section, a clipping structure and an intermediate section between the stopper contacting section and the clipping structure, wherein the clipping structure of the cage member is configured to clip in a corresponding structure of the container, wherein the cage member is configured such that the stopper contacting section of the cage member applies a pressure to the cover portion of the stopper member to push the cover portion of the stopper member onto the boundary surface of the opening of the container, when the plug portion of the stopper member is fitted into the opening of the container and the clipping structure of the cage member clips in the corresponding structure of the container, wherein the cover portion of the stopper member has a circumferential cage notch directed away from the boundary surface of the opening when the plug portion of the stopper member is fitted into the opening of the container, such that the cage notch of the cover portion of the stopper member collapses in dependence of a force applied on the stopper member when the stopper contact section of the cage member pushes the cover portion of the stopper member, wherein the cover portion of the stopper member has a circumferential container notch directed towards the boundary surface of the opening when the plug portion of the stopper member is fitted into the opening of the container, such that the cage notch of the cover portion of the stopper member collapses in dependence of a force applied on the stopper member when the stopper contact section of the cage member pushes the cover portion of the stopper member, and wherein the circumferential cage notch of the cover portion of the stopper member is radially offset relative to the circumferential container notch of the cover portion of the stopper member, and wherein the circumferential cage notch is disposed at a first radial position on the cover portion of the stopper member and the circumferential container notch is disposed at a second radial position on the cover portion at the stopper member, and wherein the circumferential cage notch is the only notch of the cover portion at the first radial position and the circumferential container notch is the only notch of the cover portion at the second radial position.

* * * * *